US009976453B2

(12) United States Patent
Aimo Boot et al.

(10) Patent No.: US 9,976,453 B2
(45) Date of Patent: May 22, 2018

(54) DEACTIVATING TAPPET

(71) Applicant: Eaton Srl, Turin (IT)

(72) Inventors: Marco Aimo Boot, Nole (IT); Salvatore Finocchiaro, Turin (IT); Alessio Courtial, Turin (IT); Piero Parmeggiani, Massa (IT)

(73) Assignee: EATON SRL, Turin (IT)

( * ) Notice: Subject to any disclaimer, the term of this patent is extended or adjusted under 35 U.S.C. 154(b) by 0 days. days.

(21) Appl. No.: 14/574,407

(22) Filed: Dec. 18, 2014

(65) Prior Publication Data

US 2015/0167507 A1 Jun. 18, 2015

(30) Foreign Application Priority Data

Dec. 18, 2013 (GB) ..... 1322406.8

(51) Int. Cl.

| | |
|---|---|
| ***F01L 13/00*** | (2006.01) |
| ***F01L 1/245*** | (2006.01) |
| ***F01L 1/24*** | (2006.01) |

(52) U.S. Cl.

CPC ..... *F01L 13/0005* (2013.01); *F01L 1/2405* (2013.01); *F01L 1/245* (2013.01); *F01L 2013/001* (2013.01); *Y10T 74/2107* (2015.01)

(58) Field of Classification Search

CPC ..... Y10T 74/2107; F02M 59/102; F01L 1/14; F01L 1/24; F01L 1/2405

See application file for complete search history.

(56) References Cited

U.S. PATENT DOCUMENTS

| | | | | |
|---|---|---|---|---|
| 2,590,719 | A * | 3/1952 | MacPherson | 123/90.28 |
| 5,782,216 | A | 7/1998 | Haas et al. | |
| 6,513,470 | B1 | 2/2003 | Hendriksma et al. | |
| 2002/0046718 | A1 | 4/2002 | Spath et al. | |
| 2003/0150859 | A1 * | 8/2003 | Reutter | 220/203.23 |
| 2003/0172889 | A1 | 9/2003 | Djordjevic | |
| 2005/0098135 | A1 | 5/2005 | Gecim | |
| 2006/0042582 | A1 * | 3/2006 | Sailer et al. | 123/90.48 |
| 2006/0225684 | A1 | 10/2006 | Spath et al. | |
| 2007/0035129 | A1 | 2/2007 | Chappaz et al. | |
| 2007/0169736 | A1 | 7/2007 | Sailer et al. | |
| 2009/0159029 | A1 | 6/2009 | Kuhl et al. | |

(Continued)

FOREIGN PATENT DOCUMENTS

| | | | |
|---|---|---|---|
| CN | 1912441 | A | 2/2007 |
| DE | 102008057830 | A | 5/2009 |

(Continued)

OTHER PUBLICATIONS

Machine translation of DE 102009033634, obtained Feb. 3, 2017.*

*Primary Examiner* — Richard W Ridley
*Assistant Examiner* — Brian J McGovern
(74) *Attorney, Agent, or Firm* — Leydig, Voit & Mayer, Ltd.

(57) ABSTRACT

A tappet includes a housing with a blind bore and with a shelf groove arranged on the inner wall of the bore; a main body slidably arranged in the bore of the housing, wherein the main body comprises a first shoulder; a secondary body telescopically arranged to the main body and having a second shoulder; a spring device arranged between the first shoulder and the second shoulder; and a locking device extendable from the main body for cooperation with the shelf groove.

10 Claims, 2 Drawing Sheets

(56) References Cited

U.S. PATENT DOCUMENTS

| | | | | |
|---|---|---|---|---|
| 2009/0199805 | A1* | 8/2009 | Hendriksma | F01L 1/2405<br>123/90.55 |
| 2011/0061615 | A1* | 3/2011 | Hendriksma | F01L 1/24<br>123/90.15 |

FOREIGN PATENT DOCUMENTS

| | | | | |
|---|---|---|---|---|
| DE | 102009033634 | A1 * | 1/2011 | F01L 1/185 |
| EP | 1020619 | A2 | 7/2000 | |
| WO | WO 2004063536 | A1 | 7/2004 | |

* cited by examiner

DEACTIVATING TAPPET

CROSS-REFERENCE TO RELATED APPLICATIONS

Priority is claimed to British Patent Application No. 1322406.8 filed on Dec. 18, 2013, the entire disclosure of which is hereby incorporated by reference herein.

FIELD

The invention relates to a deactivating tappet.

BACKGROUND

Deactivating hydraulic lash adjusters are used in combustion engines to be able to turn cylinders on or off depending on the power demanded from the engine. The motor management system of such an engine decides whether all cylinders are required for providing the desired power, or that some of the cylinders can be deactivated. This deactivating is achieved by reducing or disabling the movement of the respective valves.

For example US 2011061615 discloses a deactivating hydraulic lash adjuster. This prior art hydraulic lash adjuster or tappet has a housing with a body slidably arranged in the housing. Springs are provided to urge the body into a rest position and locking pins extend radially from the body, to lock the body in a shelf groove arranged in the housing.

In the locked position, the tappet functions as a regular tappet and valves will be moved in sync with the cylinders. If a valve needs to be deactivated a hydraulic pressure is put on a groove on the outside of the tappet. This groove is in fluid communication via a port with the locking pins. The hydraulic pins are pressed inwardly by the hydraulic pressure, such that they are released from the pin shelf and the body can freely move inside the housing.

Tappets are applied in all kinds of shapes and different sizes, such that for each application, the tappet needs to be redesigned and manufactured. Also the inner parts, such as springs, the body and the locking pins are designed depending on their application, for example the stroke the body can have in the housing in deactivated state.

The body in locked state will have some lash, which needs to be tuned to the application. When manufacturing such deactivating tappets, each tappet needs to be calibrated for this internal lash. This results in calibrating the shelf groove in the housing, which makes calibrating a deactivating tappet a laborious task. In addition calibrating is furthermore done by adjusting the thickness of the retaining ring, with which the body is confined in the housing.

SUMMARY

An aspect of the invention provides a deactivating tappet, comprising: a housing including a blind bore, and including a shelf groove arranged on an inner wall of a bore of the housing; a main body, slidably arranged in the bore of the housing, the main body including a first shoulder; a secondary body, telescopically arranged to the main body, and including a second shoulder; spring device arranged between the first shoulder and the second shoulder; a locking device extendable from the main body configured for cooperation with the shelf groove.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
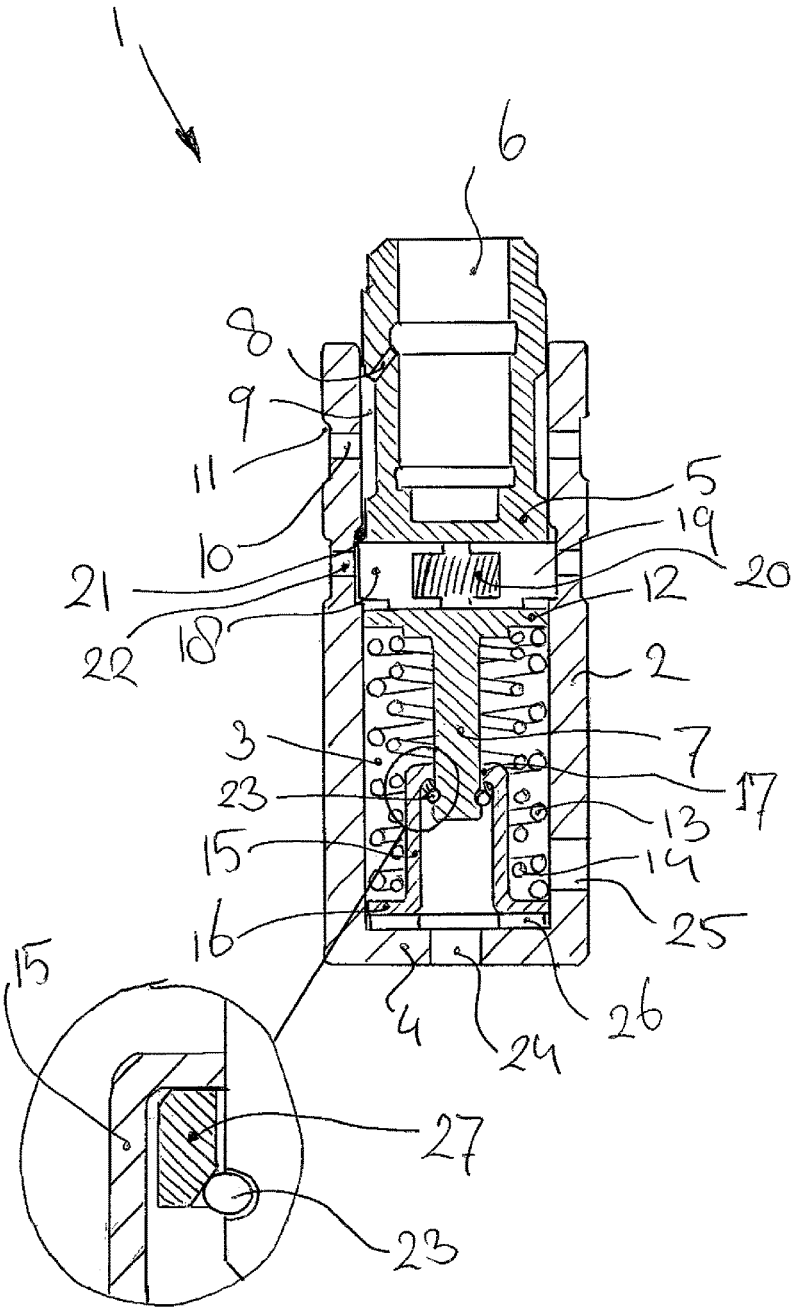
FIG. 1 shows a cross sectional view of an embodiment of a deactivating tappet according to the invention.

An aspect of the invention reduces or even removes the above mentioned disadvantages. An aspect of the invention provides a deactivating tappet, for example for use in a valve train in a combustion engine, and, more specifically, deactivating hydraulic lash adjusters.

In an embodiment, the invention provides a deactivating tappet comprising:

- a housing with a blind bore and with a shelf groove arranged on the inner wall of the bore;
- a main body slidably arranged in the bore of the housing, wherein the main body comprises a first shoulder;
- a secondary body telescopically arranged to the main body and having a second shoulder;
- spring means arranged between the first shoulder and the second shoulder;
- locking means extendable from the main body for cooperation with the shelf groove.

With the deactivation tappet according to the invention, the main body, secondary body and spring means can be handled as a separate unit, as the spring means are arranged between the first shoulder of the main body and the second shoulder of the secondary body. So, the housing can be designed and manufactured separately to the requirements of a specific engine, while the internal parts of the tappet can be designed and manufactured as a more generic separate part.

The main body and secondary body are telescopically arranged to each other, which means that the combination of the main and secondary body is able to become longer or shorter by having sections that slide inside one another.

This guides the required movement inside the tappet when the locking means are disconnected from the pin shelf, while the spring means are kept between the shoulders and urge the main body and secondary body away from each other.

In a preferred embodiment of the tappet according to the invention, the main body comprises a stem extending perpendicular from the first shoulder, wherein the secondary body comprises a tubular body with the second shoulder arranged at one end of the tubular body and with a narrowed opening at the other end, and wherein the stem extends through the narrowed opening.

The stem and the tubular body provide a telescopic arrangement and provide a guide for the spring means which are arranged around the stem and the tubular body.

Preferably, in the tappet according to the invention, the free end of the stem comprises a locking ring for preventing the free end of the stem from shifting out of the narrowed opening. In this embodiment the telescopic stroke is limited by the locking ring, which ensures that the spring means can be arranged under tension between the shoulders in the extended position of main body and secondary body. This allows one to design the internal parts with some pretension.

When the tappet is fully extended, the locking ring is preferably kept in contact with a conic gauge surface of a ring-shim. The conic surface design of the ring-shim allows to center the contact between the locking ring and the ring-shim itself, thus optimally distributing the contact pressure on the ring-shim surface against the secondary body. This ensures optimal contact among stacked components, and centering of components around the main body stem.

In yet another embodiment of the tappet according to the invention a ventilation opening is arranged in the housing near and/or in the bottom of the bore. This ventilation opening ensures that the movement of the main body inside the housing is not impeded by any pressure build up as a result of tight tolerances between the main body and the housing.

In a further preferred embodiment of the tappet according to the invention an outer circumferential groove is arranged on the housing and a channel extends between the outer circumferential groove and the shelf groove.

Yet another preferred embodiment of the tappet according to the invention comprises a filler ring arranged on the bottom of the bore. This filler ring enables one to easily calibrate the internal lash of the tappet. The thickness of the ring defines the axial position of the main body and second body within the housing and accordingly the position of the locking means relative to the shelf groove.

In still another embodiment of the tappet the main body comprises in the end facing away from the secondary body a cavity for accommodating for example a hydraulic lash adjuster.

Preferably, in the tappet according to the invention, the locking means comprise spring loaded pins arranged in a radially extending channel.

FIG. 1 shows a cross sectional view of an embodiment of a deactivating tappet 1 according to the invention. The deactivating tappet 1 has a housing 2 with an internal space 3 and a bottom 4.

The tappet 1 has furthermore a main body 5, which is axially movable in the internal space 3 of the housing 2. The main body 5 has at the top a cavity 6 for accommodating for example a hydraulic lash adjuster. To this end a first port 8 is provided, which connects the internal space 3 with a outer groove 9, which in turn is connected via a second port 10 to an outer groove 11 in the housing 2. Via this path 8, 9, 10, 11 a hydraulic fluid, such as oil, can be supplied to the cavity 6 for use by for example the hydraulic lash adjuster.

The main body 5 has at the bottom a stem 7, which is perpendicular to a first shoulder 12 on which primary spring 13 and secondary spring 14 are supported. Around the stem 7 a tubular body 15 with a second shoulder 16 is arranged. The second shoulder 16 also supports the springs 13, 14 such that the primary body and secondary body are urged away from each other. At the top of the tubular body 15, a narrowed opening 17 is provided, through which the stem 7 extends. The tip of the stem 7 is provided with a locking ring 23 to prevent the tip of the stem 7 from shifting out of the narrowed opening 17.

When the tappet 1 is fully extended, the locking ring 23 is kept in contact with a conic gauge surface of a ring-shim 27. The conic surface design of the ring-shim 27 allows to center the contact between the locking ring 23 and the ring-shim 27 itself, thus optimally distributing the contact pressure on the ring-shim 27 surface against the tubular body 15, and allowing centering of components around the main body stem 7.

The main body 5 also comprises pins 18, 19 which are arranged in a radially extending channel. The pins 18, 19 are urged radially outward by a spring 20, such that the pins 18, 19 lock with the shelf groove 21 arranged in the internal wall of the housing 2. A third port 22 is provided in the housing 2, such that a controlling hydraulic fluid can be pumped against the spring loaded pins 18, 19, such that the pins 18, 19 are released from the shelf groove 21.

Near the bottom 4 of the housing 2, ventilation openings 24, 25 are provided to prevent pressure build up, which could impede the function of the deactivating tappet 1.

Figure 2:
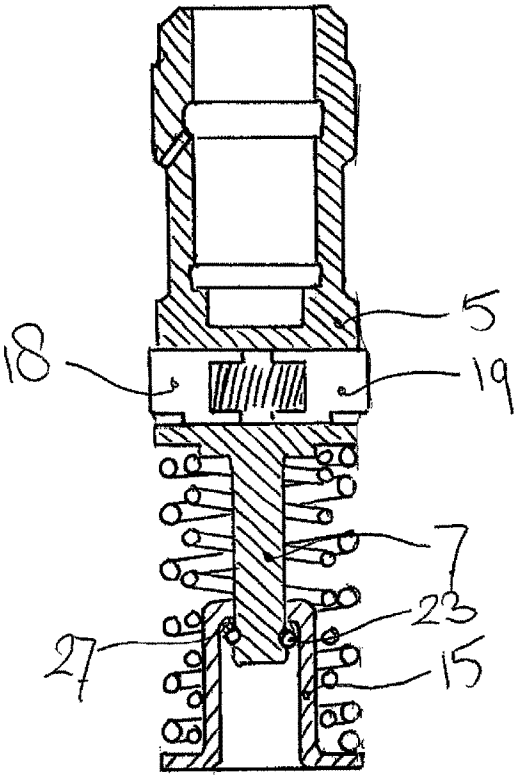
FIG. 2 shows part of the embodiment of FIG. 1.

FIG. 2 shows part of the embodiment of FIG. 1. The main body 5 and the secondary body 15 are telescopically connected to each other, such that the springs 13, 14 can be housed between the shoulders 12, 16. This enables one to handle the housing 2 and the internal parts 5, 15, 13, 14 separately.

As shown in FIG. 1, a filler ring 26 is positioned between the bottom 4 of the housing 2 and the secondary shoulder 16 of the internal parts 5, 15, 13, 14. With this filler ring 26 the lash between the pins 18, 19 and the shelf groove 21 is calibrated.

Figure 3:
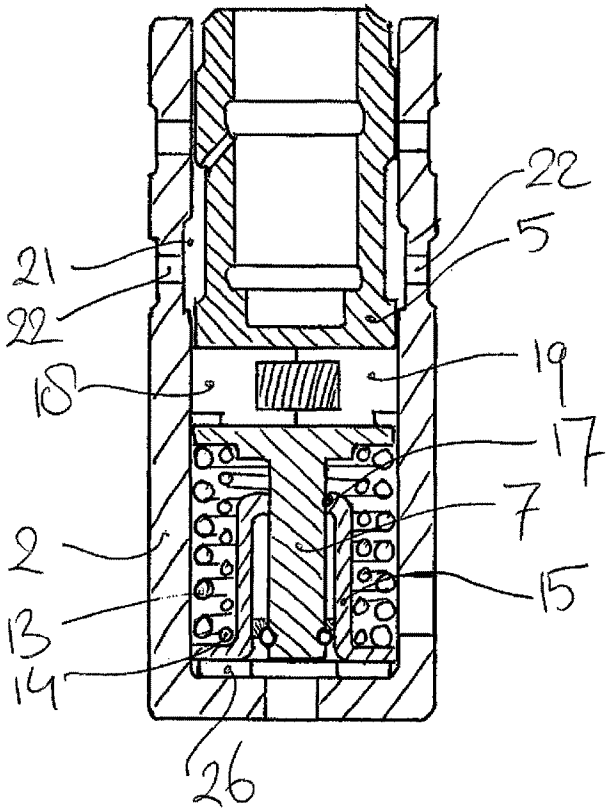
FIG. 3 shows the embodiment of FIG. 1 in deactivated state.

FIG. 3 shows the embodiment of FIG. 1 in deactivated state, wherein the third port has been supplied with pressurized fluid to urge the pins 18, 19 inwardly and release them from the shelf groove 21.

As a result, the main body 5 can be moved axially relative to the housing 2 against the pressure of the springs 13, 14, such that the stem 7 slides telescopically into the narrowed opening 17 of the secondary body 15.

In this way, the function of the tappet 1 can be deactivated to, for example, turn off a valve in a valve train inside a combustion engine.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A deactivating tappet, comprising:

a housing including an internal space, and including a shelf groove arranged on an inner wall of the housing;

a main body, slidably arranged in the internal space of the housing, the main body including a main body shoulder;

a secondary body including a secondary body shoulder;

a spring device arranged between the main body shoulder and the secondary body shoulder; and a locking device extendable from the main body configured for cooperation with the shelf groove, wherein the main body further includes a stem extending perpendicularly from the main body shoulder, wherein the secondary body further includes a tubular body, with the secondary body shoulder arranged at a first end of the tubular body and with a narrowed opening at a second end of the tubular body, wherein the stem extends through the narrowed opening, and wherein a free end of the stem includes a locking ring configured to prevent the free end of the stem from shifting out of the narrowed opening, the deactivating tappet further comprising a ring-shim including a conic gauge surface arranged around the stem, wherein the conic gauge surface faces the locking ring, wherein the stem is telescopically arranged with respect to the tubular body, the stem being slidable relative to the tubular body between a collapsed position and an extended position, and wherein the locking ring and the ring-shim are slidable with the stem relative to the tubular body between the collapsed position and the extended position.

2. The tappet of claim 1, further comprising:

a ventilation opening arranged in the housing near a bottom of the internal space.

3. The tappet of claim 1, further comprising:

an outer circumferential groove arranged on the housing; and a channel extending between the outer circumferential groove and the shelf groove.

4. The tappet of claim 1, further comprising:

a filler ring arranged on a bottom of the internal space.

5. The tappet of claim 1, wherein the main body further includes, in an end facing away from the secondary body, a cavity.

6. The tappet of claim 1, wherein the locking device further includes spring loaded pins arranged in a radially extending channel.

7. The tappet of claim 1, further comprising:

a ventilation opening arranged in the housing in a bottom of the internal space.

8. The tappet of claim 1, wherein, when the tappet is fully extended, the locking ring is kept in contact with the conic gauge surface of the ring-shim.

9. The tappet of claim 1, wherein the ring-shim centers a contact between the locking ring and the ring-shim.

10. The tappet of claim 1, wherein the locking ring has a circular cross-section in a direction perpendicular to the conic gauge surface of the ring shim.

* * * * *